US011071688B2

(12) United States Patent
Freier

(10) Patent No.: US 11,071,688 B2
(45) Date of Patent: Jul. 27, 2021

(54) STEAM SYSTEM AND METHOD

(71) Applicant: Kohler Co., Kohler, WI (US)

(72) Inventor: Donald P. Freier, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/854,106

(22) Filed: Apr. 21, 2020

(65) Prior Publication Data

US 2020/0368104 A1 Nov. 26, 2020

Related U.S. Application Data

(60) Provisional application No. 62/851,191, filed on May 22, 2019.

(51) Int. Cl.

| | |
|---|---|
| ***A61H 33/06*** | (2006.01) |
| ***F24H 9/20*** | (2006.01) |
| ***A61H 33/00*** | (2006.01) |
| ***F22B 1/28*** | (2006.01) |

(52) U.S. Cl.

CPC ..... *A61H 33/065* (2013.01); *A61H 33/6021* (2013.01); *F22B 1/287* (2013.01); *F24H 9/2028* (2013.01); *A61H 2033/068* (2013.01); *A61H 2201/5082* (2013.01)

(58) Field of Classification Search

CPC ..... A61H 33/065

USPC ..... 4/524, 535, 531, 532; 128/371, 376, 367

See application file for complete search history.

(56) References Cited

U.S. PATENT DOCUMENTS

| | | | | |
|---|---|---|---|---|
| 4,399,349 | A * | 8/1983 | Deming | A45D 19/16 128/203.17 |
| 4,862,526 | A * | 9/1989 | Berger | A61H 33/06 4/536 |
| 6,157,005 | A * | 12/2000 | Lu | A61H 33/06 219/400 |
| 7,065,907 | B2 * | 6/2006 | Valiyambath Krishnan | A61H 33/12 38/77.8 |
| 8,070,138 | B2 | 12/2011 | Saitou et al. | |
| 8,327,473 | B2 | 12/2012 | Matsubara et al. | |
| 2006/0005437 | A1 * | 1/2006 | Valiyambath Krishnan | F22B 1/287 38/77.8 |
| 2008/0223788 | A1 * | 9/2008 | Rimdzius | A61H 33/06 210/664 |

(Continued)

FOREIGN PATENT DOCUMENTS

| | | |
|---|---|---|
| CN | 201858628 | 6/2011 |
| WO | WO-2006/118336 | 11/2006 |
| WO | WO-2008/129119 | 10/2008 |

*Primary Examiner* — Lori L Baker

(74) *Attorney, Agent, or Firm* — Foley & Lardner LLP

(57) ABSTRACT

A steam generator for a shower steam system includes a first chamber, a second chamber, and an intermediate heat transfer member. The first chamber is configured to receive water. The second chamber is configured to receive a flow of air. The intermediate heat transfer member fluidly separates the first chamber from the second chamber. The intermediate heat transfer member includes a heating element configured to generate heat energy. The intermediate heat transfer member is configured to transfer heat energy generated by the heating element to the first chamber to generate steam in the first chamber, and transfer heat energy generated by the heating element to the flow of air in the second chamber.

20 Claims, 4 Drawing Sheets

(56) References Cited

U.S. PATENT DOCUMENTS

| | | | | |
|---|---|---|---|---|
| 2008/0282995 | A1* | 11/2008 | Kuan | F22B 1/288 122/32 |
| 2011/0197828 | A1* | 8/2011 | Iskrenovic | F22B 1/28 122/1 R |
| 2011/0209283 | A1* | 9/2011 | Chen | A61H 33/066 4/524 |
| 2013/0305448 | A1* | 11/2013 | Nguyen | A61H 33/06 4/533 |
| 2014/0345041 | A1* | 11/2014 | Barghelame | D06F 58/30 4/526 |
| 2020/0306783 | A1* | 10/2020 | Freier | A61H 33/065 |

* cited by examiner

STEAM SYSTEM AND METHOD

CROSS-REFERENCE TO RELATED PATENT APPLICATION

This application claims the benefit of and priority to U.S. Provisional Application No. 62/851,191, filed May 22, 2019, the entire disclosure of which is hereby incorporated by reference herein.

BACKGROUND

The present disclosure relates generally to steam systems and, more specifically, to steam generators for controlling temperature and humidity in a sauna or a shower environment.

In a conventional steam generator, a heating element is typically submerged in a tank filled with water. The heating element can be operated to heat the water until the water boils to generate steam for use in, for example, a sauna or a shower environment. This arrangement typically requires a significant amount of heat to increase the temperature of the water in the tank before any steam is generated, which can result in relatively long startup times. Furthermore, the direct contact between the heating element and the water can result in a gradual deposit of calcium on the heating element, which can reduce the lifespan of the heating element.

In addition, the heating element in a conventional steam generator typically cycles on and off to maintain an average temperature in an environment, which can lead to temperature fluctuations in the water and difficulty in precisely controlling the level of humidity downstream of the steam generator.

It would be advantageous to provide a steam generator that addresses one or more of the above noted deficiencies associated with conventional steam generators. These and other advantageous features will become apparent to those reviewing the present disclosure.

SUMMARY

At least one embodiment relates to a steam generator for a shower steam system. The steam generator includes a first chamber, a second chamber, and an intermediate heat transfer member. The first chamber is configured to receive water. The second chamber is configured to receive a flow of air. The intermediate heat transfer member fluidly separates the first chamber from the second chamber. The intermediate heat transfer member includes a heating element configured to generate heat energy. The intermediate heat transfer member is configured to transfer heat energy generated by the heating element to the first chamber to generate steam in the first chamber, and transfer heat energy generated by the heating element to the flow of air in the second chamber.

Another embodiment relates to a shower steam system. The shower steam system includes a steam generator, a spray nozzle, and a blower. The steam generator includes a first chamber, a second chamber, and an intermediate heat transfer member fluidly separating the first chamber from the second chamber. The intermediate heat transfer member includes a heating element configured to generate heat energy. The spray nozzle is in fluid communication with the first chamber, and is configured to provide an atomized spray of water to the first chamber. The blower is in fluid communication with the second chamber, and is configured to provide a flow of air to the second chamber. The intermediate heat transfer member is configured to transfer heat energy generated by the heating element to the atomized spray of water in the first chamber to generate steam, and transfer heat energy generated by the heating element to the flow of air in the second chamber to heat the flow of air.

Another embodiment relates to a method of generating at least one of steam or heated air in a shower steam system. The method includes receiving, by a steam generator, a signal to produce at least one of steam or heated air. The steam generator includes a first chamber, a second chamber, and an intermediate heat transfer member fluidly separating the first chamber from the second chamber. The intermediate heat transfer member includes a heating element. The method further includes providing at least one of water to the first chamber or a flow of air to the second chamber in response to the received signal. The method further includes generating, by the heating element, heat energy in response to the received signal. The method further includes transferring, by the intermediate heat transfer member, the generated heat energy to the first chamber and the second chamber.

DETAILED DESCRIPTION

Referring generally to the FIGURES, disclosed herein is a steam system and method that includes a steam generator for providing steam and heated air to, for example, a sauna or a shower environment. The disclosed steam generator includes a first chamber (e.g., a steam chamber, etc.) for receiving water from a water source. The first chamber is in fluid communication with an area to receive steam, such as a sauna, a shower environment, or other area for receiving steam. The steam generator further includes an intermediate heat transfer member including a heating element coupled to, or integrally formed with, the intermediate heat transfer member. The intermediate heat transfer member fluidly separates the first chamber from a second chamber (e.g., an air chamber, etc.) of the steam generator. The second chamber can receive a flow of air from an air supply source. The intermediate heat transfer member can transfer heat energy generated by the heating element to the flow of air to produce heated air. The intermediate heat transfer member can also transfer heat energy from the heating element to indirectly heat the water received in the first chamber to produce steam. The heated air and steam generated by the steam generator are separately provided to the shower environment or sauna to control the humidity and temperature therein.

The intermediate heat transfer member of the steam generator can, advantageously, help to distribute heat energy produced by the heating element to water within the first chamber, while avoiding direct contact between the water and the heating element. In this manner, the disclosed steam generator can heat water more efficiently and quickly to produce steam, as compared to conventional steam generators. In addition, since the heating element is not submerged or otherwise in direct contact with the water in the first chamber, the heating element is less likely to develop calcium deposits, thereby prolonging the useful life of the heating element. Additionally, by separately providing heated air and steam to an environment, the disclosed system allows for greater and more precise control of temperature and humidity in the environment, as compared to conventional steam systems, which typically just cycle on and off to maintain an average temperature in an environment.

Figure 1:
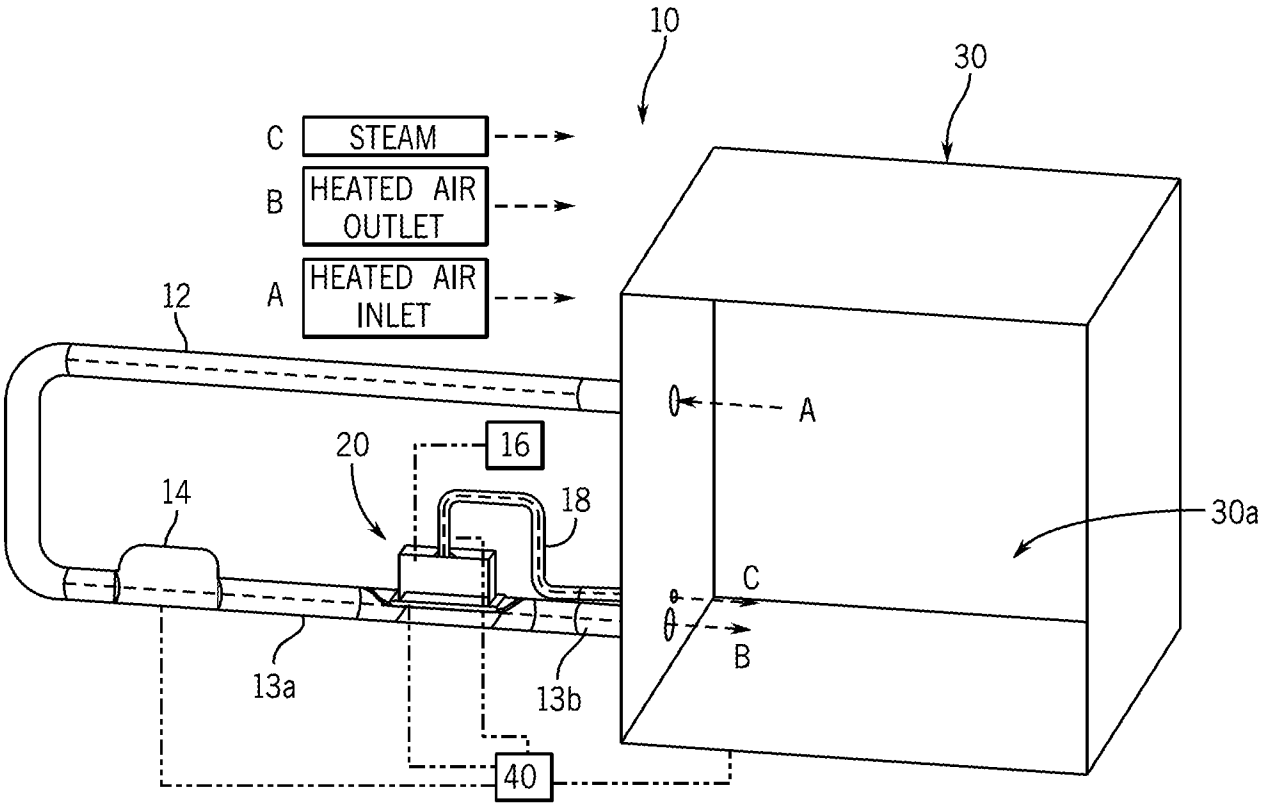
FIG. 1 is a schematic illustration of a steam system including a steam generator according to an exemplary embodiment.
Figure 2:
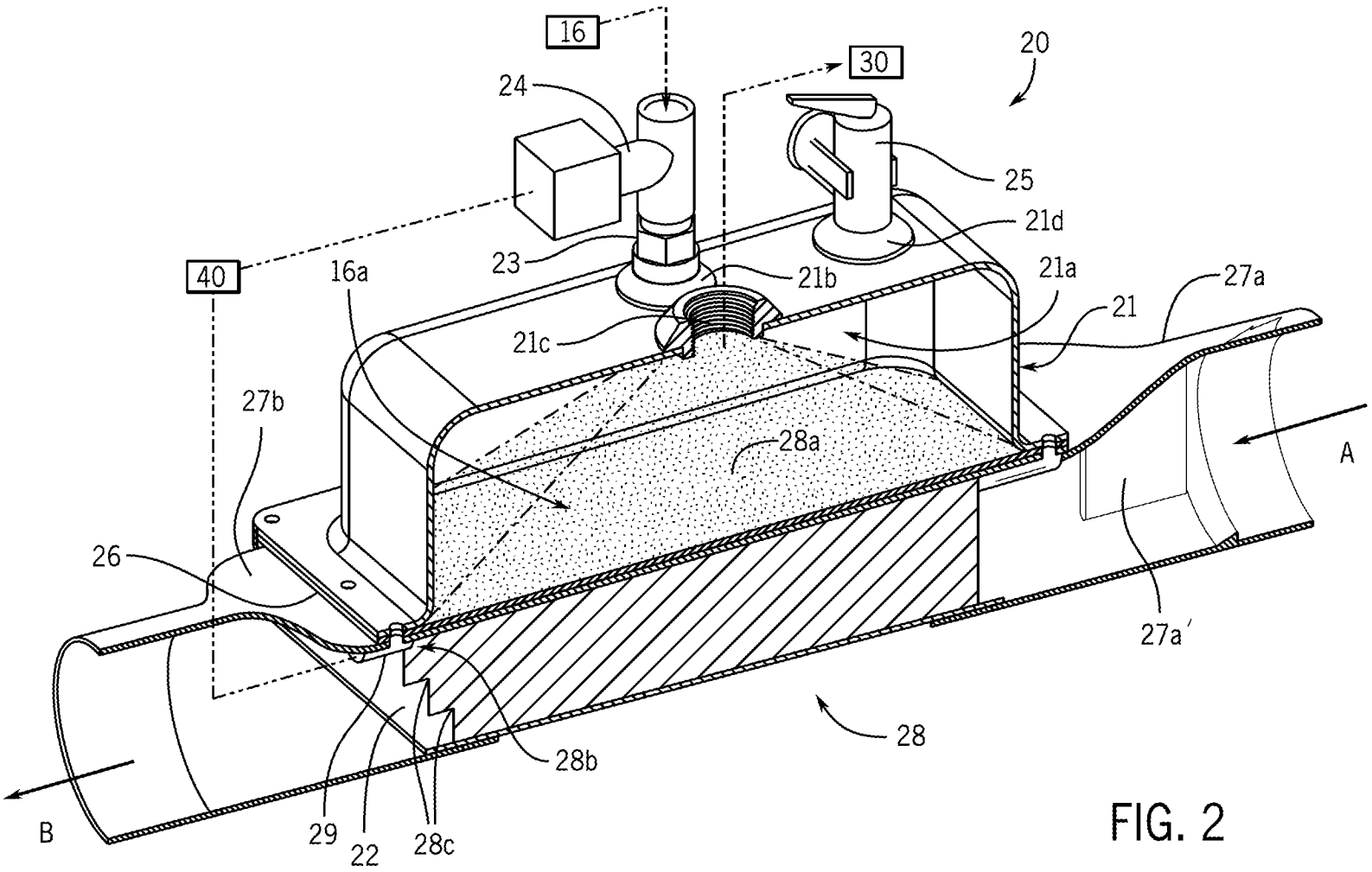
FIG. 2 is a partial cutaway view of the steam generator of FIG. 1.

Referring to FIGS. 1-2, a steam system 10 is shown according to an exemplary embodiment. The steam system 10 includes a steam generator 20 in fluid communication with an environment, shown schematically as an enclosure 30 that defines an interior space 30*a*, for receiving steam and heated air from the steam generator 20. According to various exemplary embodiments, the enclosure 30 may be a sauna, a shower environment, or any other area for receiving steam and heated air. The enclosure 30 may be a partial or full enclosure, according to various exemplary embodiments. The steam system 10 further includes a blower 14 (e.g., air blower, air pump, etc.) fluidly coupled to the enclosure 30 by a first conduit 12. The blower 14 is also fluidly coupled to the steam generator 20 by a second conduit 13*a*. The blower 14 is configured to receive a flow of air (represented by arrow "A" in FIG. 1) from an air supply source, which is shown as the interior space 30*a* in the embodiment of FIG. 1, although the flow of air may be received from a different air supply source, such as ambient, according to other exemplary embodiments. The blower 14 is further configured to direct the flow of air A to the steam generator 20 via the second conduit 13*a*. The steam generator 20 includes an intermediate heat transfer member 28 that is configured to heat the flow of air A and provide a heated flow of air (represented by arrow "B" in FIG. 1) via a third conduit 13*b* to the interior space 30*a*, so as to adjust the temperature of the interior space 30*a*.

Referring to FIGS. 1-2, the steam generator 20 is also fluidly coupled to a water supply source 16, such as a household water supply, although other water supply sources may be used, according to other exemplary embodiments. The steam generator 20 is configured to receive a flow of water from the water supply source 16, and to heat the received water via the intermediate heat transfer member 28 to generate steam. The steam generator 20 is configured to direct the generated steam (represented by arrow "C" in FIG. 1) via a fourth conduit 18 to the interior space 30*a* of the enclosure 30, where the steam can be combined with the heated air generated by the steam generator 20. The steam may be provided to selectively increase the humidity of the interior space 30*a*. In this manner, the steam system 10 can separately provide heated air and steam to a sauna or shower environment to provide for greater and more precise control of temperature and humidity, as compared to conventional systems that typically provide a combined flow of air and steam to an environment.

Figure 3:
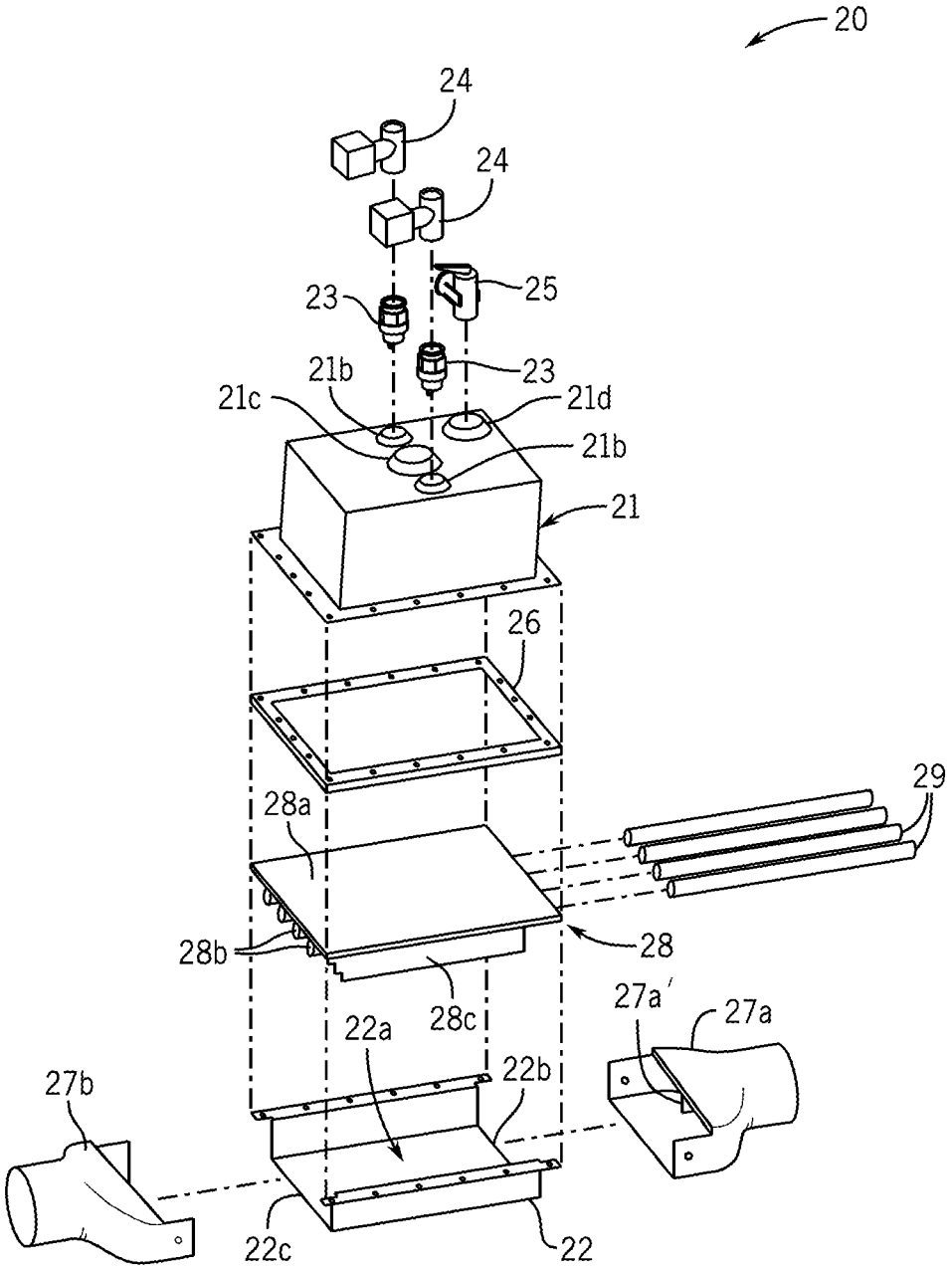
FIG. 3 is an exploded view of the steam generator of FIG. 1.

Referring to FIGS. 2-3, the steam generator 20 includes a first housing 21 that defines a first chamber 21*a*. The first housing 21 has a generally cuboidal shape with an open bottom portion to provide access to the first chamber 21*a*. According to other exemplary embodiments, the first housing 21 may have other shapes, such as spherical, hemispherical, trapezoidal, or other shapes that define a chamber. An upper portion of the first housing 21 includes a plurality of openings for receiving various components in the first chamber 21*a*. For example, the first housing 21 includes a pair of first openings 21*b* for receiving spray nozzles 23, respectively, at least partially therein. According to other exemplary embodiments, the first housing 21 may include more or fewer than two openings 21*b* to receive a different number of spray nozzles 23. The first housing 21 further includes a second opening 21*c* located at a middle portion of the housing 21. The second opening 21*c* is configured to be coupled to the fourth conduit 18 to fluidly couple the first chamber 21*a* to the enclosure 30, so as to distribute steam generated by the steam generator 20 to the enclosure 30. The first housing 21 further includes a third opening 21*d* for receiving a pressure relief valve 25 at least partially therein for controlling pressure in the first chamber 21*a*.

According to the exemplary embodiment of FIGS. 2-3, each of the spray nozzles 23 includes a solenoid 24 that is electrically coupled to a control system 40. Each of the spray nozzles 23 is also fluidly coupled to the water supply source 16. The spray nozzles 23 are configured to receive a flow of water from the water supply source 16 and to provide an atomized spray of water 16*a* (e.g., fine water spray droplets, etc.) into the first chamber 21*a* in response to a signal received by the solenoids 24 from the control system 40. The received signal may be indicative of a request to produce steam in a sauna or shower environment to raise the humidity in the environment. The signal may be from a sensor (e.g., in response to a humidity level dropping below a threshold value, etc.), a mobile device, a thermostat, or other source. According to an exemplary embodiment, the water flow rate to the spray nozzles 23 can be selectively controlled to adjust the temperature/humidity of the enclosure 30. For example, the solenoids 24 may be modulated between on and off to provide greater control of temperature, as compared to conventional systems which can have large temperature swings. According to an exemplary embodiment, when the steam room or shower environment reaches a desire ambient temperature, the solenoids 24 can be pulsed on and off for a period of time to reduce the flow of water, thereby making less steam. This allows the temperature in the steam room or shower environment to be controlled more precisely.

Still referring to FIGS. 2-3, the steam generator 20 further includes a second housing 22 (e.g., manifold, air distributor, etc.) coupled to the first housing 21 below the open bottom portion of the first housing 21. The second housing 22 has a second chamber 22*a* that is defined by a lower wall and two substantially parallel sidewalls. The second housing 22 defines a first end 22*b* and an opposite second end 22*c*. The steam generator 20 further includes an inlet adapter 27*a* coupled to, or integrally formed with, the first end 22*b*. The steam generator 20 further includes an outlet adapter 27*b* coupled to, or integrally formed with, the second end 22*c*. The inlet adapter 27*a* is configured to be coupled to the second conduit 13*a* to fluidly couple the second chamber 22*a* to the blower 14. The inlet adapter 27*a* includes a partition 27*a*' disposed therein for distributing or redirecting the flow of air from the blower 14 toward the heat transfer elements of the intermediate heat transfer member 28 to heat the flow of air, the details of which are discussed in the paragraphs that follow. The outlet adapter 27*b* is configured to be coupled to the third conduit 13*b* to fluidly couple the second chamber 22*a* to the enclosure 30, so as to direct heated air to the enclosure 30. For example, the blower 14 can be selectively operated in response to a signal received from the control system 40 to provide a flow of air to the second chamber 22*a*. The received signal may be indicative of a request to produce heated air in a sauna or shower environment to raise the temperature in the environment. The signal may be from a sensor (e.g., in response to a temperature level dropping below a threshold value, etc.), a mobile device, a thermostat, or other source. According to an exemplary embodiment, the air volume from the blower 14 can be selectively controlled to adjust the temperature/humidity of the enclosure 30.

Still referring to FIGS. 2-3, the steam generator 20 further includes an intermediate heat transfer member 28 disposed between the first housing 21 and the second housing 22. The intermediate heat transfer member 28 fluidly separates the first chamber 21*a* from the second chamber 22*a*. A sealing member 26 (e.g., gasket, etc.) may be disposed between the first housing 21 and the intermediate heat transfer member 28, so as to provide a substantially watertight seal of the first chamber 21*a* from the second chamber 22*a*. The intermediate heat transfer member 28 includes an upper portion 28*a* that is configured to be at least partially exposed in the first chamber 21*a*. The upper portion 28*a* can extend the entire surface area of the open bottom portion of the first housing 21, so as to cooperatively define a full enclosure of the first chamber 21*a*. In other words, the top surface of the upper portion 28*a* defines a bottom wall of the first chamber 21. The upper portion 28*a* is configured to distribute heat energy to the atomized spray of water 16*a* in the first chamber 21*a*, so as to generate steam in the first chamber 21*a*, the details of which are discussed below. In the embodiment shown, the upper portion 28*a* is substantially planar, however, it should be appreciated that the upper portion 28*a* may be substantially non-planar or include substantially non-planar portions, according to other exemplary embodiments.

The intermediate heat transfer member 28 further includes a middle portion 28*b* extending from the upper portion 28*a*. The middle portion 28*b* includes one or more heating elements 29 disposed therein. According to an exemplary embodiment, the heating elements 29 are integrally formed with the intermediate heat transfer member 28 to define a unitary member. According to other exemplary embodiments, the heating elements 29 are coupled to the middle portion 28*b* in corresponding openings defined therein. The heating elements 29 may be resistive heating rods that are electrically coupled to the control system 40 of the steam system 10, so as to allow for the selective control of the heating elements 29, although it should be appreciated that other types of heat generating elements may be used instead, according to other exemplary embodiments. The heating elements 29 are configured to produce heat energy in response to a signal received from the control system 40, so as to selectively produce steam and/or heated air to control the humidity and/or temperature of an environment. According to an exemplary embodiment, the heating elements 29 can be selectively turned on and off to adjust the humidity/temperature in the enclosure 30.

The intermediate heat transfer member 28 further includes a plurality of heat transfer elements, shown as fins 28*c*, extending away from the middle portion 28*b* toward the second housing 22. The fins 28*c* are arranged laterally spaced apart from each other, and each extending lengthwise between the first end 22*b* and the second end 22*c*. The fins 28*c* extend longitudinally into the second chamber 22*a* from the middle portion 28*b*, so as to distribute heat energy from the heating elements 29 via conduction to a flow of air received in the second chamber 22*a* (e.g., from blower 14, etc.). The intermediate heat transfer member 28 is also configured to distribute heat energy from the heating elements 29 to the upper portion 28*a* via conduction, so as to generate steam within the first chamber 21*a*. The intermediate heat transfer member 28 may be made from a rigid or a substantially rigid material having good heat transfer properties, such as aluminum. In this way, the steam generator 20 can heat water more efficiently and quickly to produce steam, as compared to conventional steam generators. In addition, since the heating elements 29 are not submerged or otherwise in direct contact with the water in the first chamber 21*a*, the heating elements 29 are less likely to develop calcium deposits, thereby prolonging the useful life of the heating elements 29.

Figure 4:
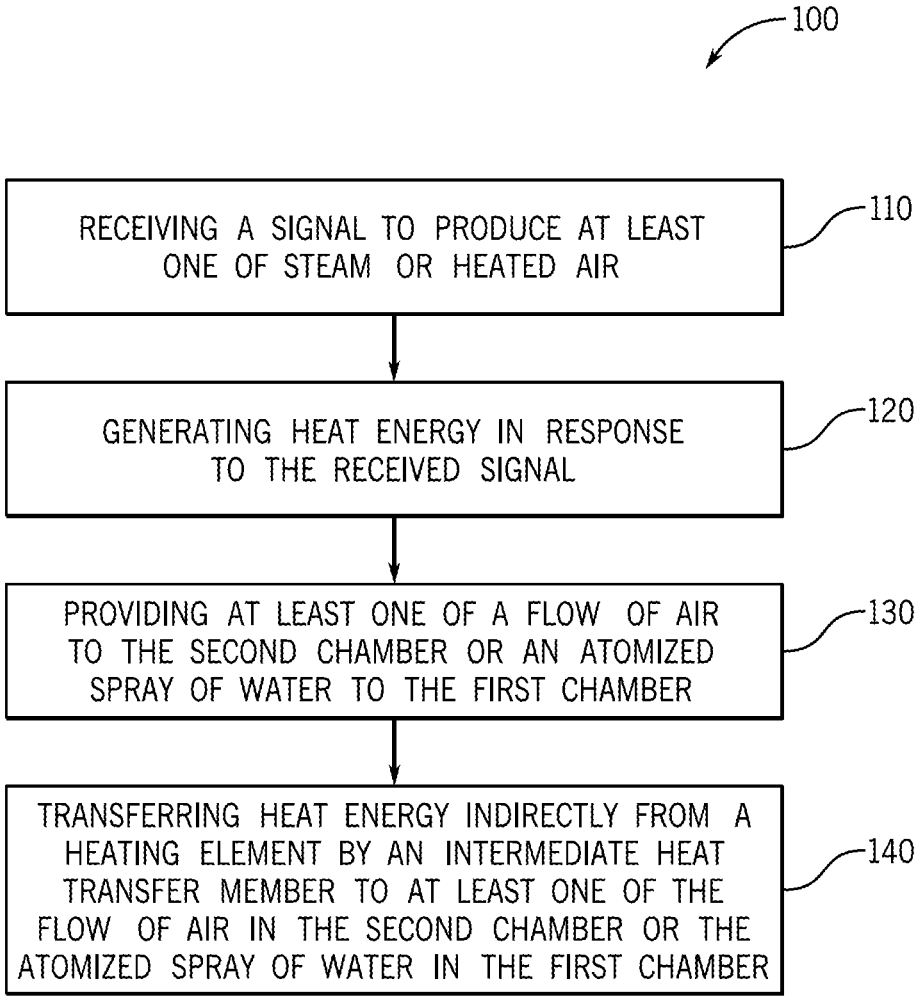
FIG. 4 is a flow diagram illustrating a method of generating steam and heated air according to another exemplary embodiment.

Referring to FIG. 4, a method 100 of generating steam and heated air for a sauna or a shower environment is shown according to an exemplary embodiment. In a first step 110, the control system 40 receives a signal (e.g., from a sensor, a mobile device, a thermostat, etc.) to produce at least one of steam or heated air to adjust the humidity and/or temperature of a sauna or a shower environment. In response to the received signal, the heating elements 29 of the steam generator 20 are operated to generate heat energy in a second step 120. If the received signal is indicative of a request for heated air, such as to raise the temperature, the blower 14 can be selectively operated to provide a flow of air to the second chamber 22*a* of the steam generator 20 in a third step 130. The heat energy generated by the heating elements 29 can be transferred to the flow of air via the intermediate heat transfer member 28 (e.g., the fins 28*c*, etc.), so as to generate heated air in the second chamber 22*a* in a fourth step 140. The heated air can be provided from the second chamber 22*a* to the sauna or the shower environment to adjust the temperature. If the received signal from the control system 40 is indicative of a request for steam, such as to raise the humidity, the spray nozzles 23 can be selectively operated to provide an atomized spray of water 16*a* from the water supply source 16 to the first chamber 21*a* of the steam generator 20 in the third step 130. The heat energy generated by the heating elements 29 can be indirectly transferred to the atomized spray of water 16*a* via the intermediate heat transfer member 28 (e.g., the upper portion 28*a*, etc.), so as to generate steam in the first chamber 21*a* in the fourth step 140. The steam can be provided from the first chamber 21*a* to the sauna or the shower environment to adjust the humidity.

In this manner, the disclosed steam generator 20 can heat water more efficiently and quickly to produce steam, as compared to conventional steam generators. In addition, since the heating elements 29 are not submerged or otherwise in direct contact with the water in the first chamber 21*a*, the heating elements 29 are less likely to develop calcium deposits, thereby prolonging the useful life of the heating elements 29. Additionally, by separately providing heated air and steam to an environment, the disclosed system allows for greater control of temperature and humidity in the environment, as compared to conventional steam systems. Furthermore, the disclosed system allows for more precise control of humidity/temperature of an environment by allowing for control of water flow rate to the spray nozzles 23, air volume from the blower 14, or operation of heating elements 29.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein.

What is claimed is:

1. A steam generator for a shower steam system, the steam generator comprising:

a first chamber configured to receive water;

a second chamber configured to receive a flow of air; and an intermediate heat transfer member fluidly separating the first chamber from the second chamber, the intermediate heat transfer member including a heating element configured to generate heat energy;

wherein the intermediate heat transfer member is configured to:

transfer heat energy generated by the heating element to the first chamber to generate steam in the first chamber, and transfer heat energy generated by the heating element to the flow of air in the second chamber.

2. The steam generator of claim 1, wherein the first chamber is defined by a first housing, and wherein the second chamber is defined by a second housing coupled to the first housing.

3. The steam generator of claim 1, wherein the first chamber is configured to be in fluid communication with an enclosure by a first flow path, and wherein the second chamber is configured to be in fluid communication with the enclosure by a second flow path that is separate from the first flow path.

4. The steam generator of claim 1, wherein the heating element is physically separated from the first chamber and the second chamber by the intermediate heat transfer member.

5. The steam generator of claim 1, further comprising a spray nozzle in fluid communication with the first chamber, wherein the spray nozzle is configured to provide an atomized spray of water to the first chamber.

6. The steam generator of claim 1, wherein the second chamber is configured to receive the flow of air from a blower.

7. The steam generator of claim 1, wherein the intermediate heat transfer member comprises:

an upper portion configured to be at least partially exposed in the first chamber;

a middle portion including the heating element; and a plurality of heat transfer elements extending from the middle portion into the second chamber.

8. The steam generator of claim 7, wherein the upper portion is configured to transfer heat energy from the heating element to the first chamber, and wherein the plurality of heat transfer elements are configured to transfer heat energy from the heating element to the second chamber.

9. The steam generator of claim 7, wherein the plurality of heat transfer elements are fins.

10. A shower steam system comprising:

a steam generator, the steam generator comprising:

a first chamber;

a second chamber; and an intermediate heat transfer member fluidly separating the first chamber from the second chamber, the intermediate heat transfer member including a heating element configured to generate heat energy;

a spray nozzle in fluid communication with the first chamber, wherein the spray nozzle is configured to provide an atomized spray of water to the first chamber; and a blower in fluid communication with the second chamber, the blower configured to provide a flow of air to the second chamber;

wherein the intermediate heat transfer member is configured to:

transfer heat energy generated by the heating element to the atomized spray of water in the first chamber to generate steam, and transfer heat energy generated by the heating element to the flow of air in the second chamber to heat the flow of air.

11. The shower steam system of claim 10, wherein the first chamber is defined by a first housing, and wherein the second chamber is defined by a second housing coupled to the first housing.

12. The shower steam system of claim 10, wherein the first chamber is configured to be in fluid communication with an enclosure by a first flow path, and wherein the second chamber is configured to be in fluid communication with the enclosure by a second flow path that is separate from the first flow path.

13. The shower steam system of claim 10, wherein the heating element is physically separated from the first chamber and the second chamber by the intermediate heat transfer member.

14. The shower steam system of claim 10, wherein the intermediate heat transfer member comprises:

an upper portion configured to be at least partially exposed in the first chamber;

a middle portion including the heating element; and a plurality of heat transfer elements extending from the middle portion into the second chamber.

15. The shower steam system of claim 10, wherein the upper portion is configured to transfer heat energy from the heating element to the first chamber, and wherein the plurality of heat transfer elements are configured to transfer heat energy from the heating element to the second chamber.

16. The shower steam system of claim 15, wherein the plurality of heat transfer elements are fins.

17. A method of generating at least one of steam or heated air in a shower steam system, the method comprising:

receiving, by a steam generator, a signal to produce at least one of steam or heated air, the steam generator comprising:

a first chamber;

a second chamber; and an intermediate heat transfer member fluidly separating the first chamber from the second chamber, the intermediate heat transfer member including a heating element;

providing at least one of water to the first chamber or a flow of air to the second chamber in response to the received signal;

generating, by the heating element, heat energy in response to the received signal; and transferring, by the intermediate heat transfer member, the generated heat energy to the first chamber and the second chamber.

18. The method of claim 17, wherein providing water to the first chamber includes spraying, by a spray nozzle of the shower steam system, an atomized spray of water into the first chamber.

19. The method of claim 17, wherein providing the flow of air to the second chamber includes generating, by a blower of the shower steam system, the flow of air.

20. The method of claim 17, wherein receiving the signal to produce at least one of steam or heated air includes receiving, by a controller of the shower steam system, the signal.

* * * * *